US005403984A

United States Patent [19]

Ogawa

[11] Patent Number: 5,403,984

[45] Date of Patent: Apr. 4, 1995

[54] RUBBER CONTACT SWITCH

[75] Inventor: Kikuo Ogawa, Shizuoka, Japan

[73] Assignee: Yazaki Corporation, Japan

[21] Appl. No.: 80,122

[22] Filed: Jun. 23, 1993

[30] Foreign Application Priority Data

Jun. 23, 1992 [JP] Japan ..... 4-043543 U

[51] Int. Cl.[6] ..... H01H 1/10

[52] U.S. Cl. ..... 200/517; 200/313; 200/314

[58] Field of Search ..... 200/313, 314, 315, 339, 200/302.3, 517, 5 R, 5 B, 16 R, 512, 513, 520, 534, 553, 561, 310, 311, 341, 345, DIG. 47

[56] References Cited

U.S. PATENT DOCUMENTS

| | | | |
|---|---|---|---|
| 4,670,633 | 6/1987 | Kaiwa et al. | 200/314 |
| 4,677,268 | 6/1987 | Nemeth et al. | 200/513 |
| 4,710,602 | 12/1987 | Baity et al. | 200/315 |
| 4,710,858 | 12/1987 | Van Hout et al. | 200/315 X |
| 4,885,443 | 12/1989 | Simcoe et al. | 200/314 X |
| 4,929,804 | 5/1990 | Kawai et al. | 200/339 X |
| 4,937,408 | 6/1990 | Hattori et al. | 200/314 |

FOREIGN PATENT DOCUMENTS

| | | | |
|---|---|---|---|
| 59-188634 | 12/1984 | Japan . | |
| 63-19296 | 2/1988 | Japan . | |
| 63-19297 | 2/1988 | Japan . | |
| 63-19298 | 2/1988 | Japan . | |
| 63-19299 | 2/1988 | Japan . | |
| 2065373 | 6/1981 | United Kingdom | 200/314 |

*Primary Examiner*—Henry J. Recla
*Assistant Examiner*—David J. Walczak
*Attorney, Agent, or Firm*—Wigman, Cohen, Leitner & Myers

[57] ABSTRACT

A rubber contact portion, a drive member and an illuminant are mounted on a housing. The rubber contact portion is made of a transparent material and has electrical contacts which come into contact with or estranged from each other. The drive member is made of a transparent material and is supported on the housing so as to reciprocate to the rubber contact portion. The illuminant is mounted to face a base portion of the drive member.

17 Claims, 2 Drawing Sheets

RUBBER CONTACT SWITCH

BACKGROUND OF THE INVENTION

This invention relates to a rubber contact switch, and in particular to a rubber contact switch with a lighting function which is used for an on-off switch provided for motor vehicle and the like.

Recently, a motor vehicle has been improved to be equipped with the comforts, so that it becomes possible to open and close a window, adjust a rear mirror, and lock a door by electric motor control. According to such a situation, various switches are adopted to perform these operations by electric motor control.

A rubber contact switch has a rubber contacting point. The rubber contact switch is widely used as an open-close switch of a power window, or as an adjustment switch of a door mirror or a car audio.

SUMMARY OF THE INVENTION

It is therefore an object of the invention to provide a rubber contact switch which has high flexibility of a lighting point and high lighting efficiency.

It is another object of the invention to provide a rubber contact switch which has superior water-proof and dust-proof performance.

It is still another object of the invention to provide a rubber contact switch of reduce cost by reducing the number of components.

To accomplish the above mentioned objects, the present invention provides a rubber contact switch comprising:

a housing;

a rubber contact portion disposed inside the housing, being mainly made of transparent material, and having electrical contacts to come into contact with or estranged from each other;

a drive member supported on the housing so as to be capable of reciprocating to the rubber contact portion, and being made of transparent material; and an illuminant being arranged so as to face a base of the drive member.

In the present invention, light which comes from an illuminant goes into the base of the drive member and is conducted in the drive member and then comes out from the edge of the drive member. The light from the drive member illuminates the predetermined illuminating point.

DESCRIPTION OF THE PREFERRED EMBODIMENTS

Figure 1:
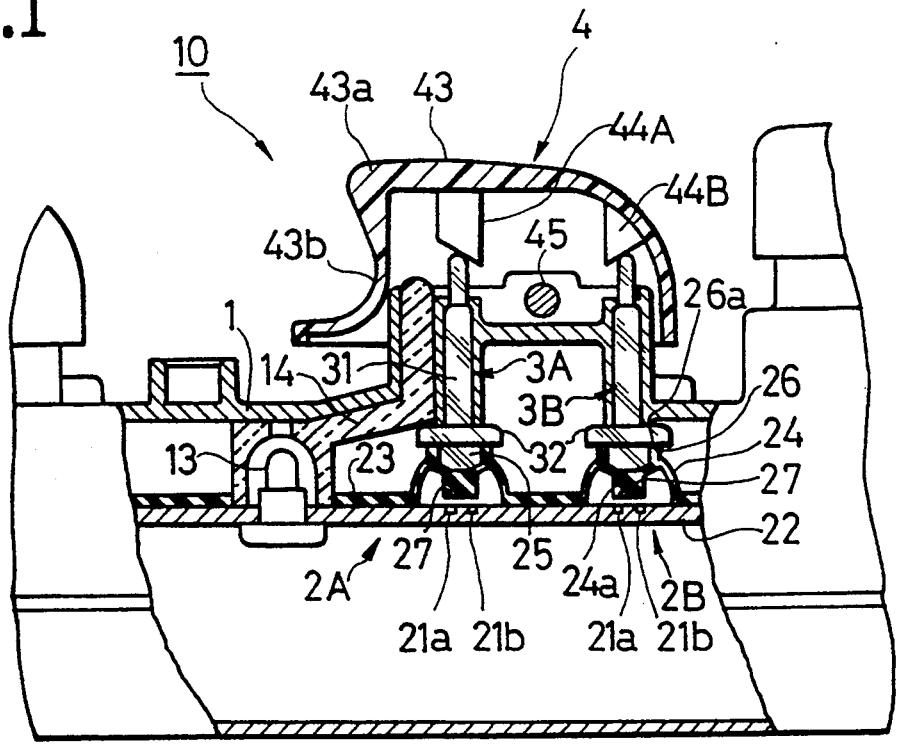
FIG. 1 is a sectional view showing a switch portion of a rubber contact switch according to the first embodiment of the invention.

FIG. 1 is a sectional view showing a basic component of a rubber contact switch 10 according to the first embodiment of the invention. The rubber contact switch 10 is preferably used as an open-close switch for a power window in motor vehicle. The rubber contact switch 10 includes a housing 1, rubber contact portions

2A, 2B, rubber contact drive members 3A, 3B and a knob 4. When the knob 4 is pressed, the rubber contact driving members 3A, 3B are pressed down and accordingly the rubber contact portions 2A, 2B are also pressed down and the rubber contact portions 2A, 2B conduct with two fixed connect points disposed on a base plate 22, respectively.

The rubber contact portions 2A, 2B are integrally formed on a base member 23, respectively. The rubber contact portions 2A, 2B have hollow domes 24, movable contact points 27 and ring tops 26. The hollow domes 24 are made of rubber and are mounted on the base plate 22 to cover two fixed contact posts **21*a*, 21*b* disposed on the base plate 22. The movable contact points 27 are mounted opposed to the above mentioned two fixed contact points 21*a*, 21*b*, respectively, and mounted on the points of protrusions 24*a* which protrude downwardly from a rear side of the above mentioned hollow domes 24, respectively. The ring tops 26 have a cylindrical wall shape and are provided on tops of the domes 24** to surround the tops.

The knob 4 is rotatably supported by a rotation shaft 45. Protrusions 44A, 44B are formed on a downward facing surface of the knob 4. The protrusions 44A, 44B contact with tips of the rubber contact drive member 3A, 3B, respectively, without adding an external force. A main body 43 of the knob 4 has an asymmetrical shape to the rotation shaft 45. According to FIG. 1, the right side of the main body 43 has a round shape which is difficult to be pressed. On the other hand, the left side of the main body 43 extends horizontally and a press portion **43*a* is formed on a left end of the main body 43. A pull up portion 43*b* is disposed under the press portion 43*a* and has a concave shape for the operation of pulling up the main body 43**.

The rubber contact drive members 3A, 3B are respectively composed of the shaft members 31 and the flange portions 32. The flange portions 32 are disklike in shape and are disposed on one end of the shaft members 31. The shaft members 31 are slidably mounted on the housing 1 in the axial direction thereof. The flange portions 32 have a greater diameter than that of the ring tops 26. The flange portions 32 are positioned, respectively, on the rubber contact portion 2A, 2B to come in close contact with the cylindrical top faces **26*a* of the ring tops 26, so that spaces 25 are formed inside of the ring tops 26. The flange portions 32 have an through holes to communicate the inner spaces 25** with the outside.

In the case of illuminating the knob 4, rubber contact drive members 3A, 3B are mounted right under the desired illuminating position on the knob 4 and the illuminant 13 is positioned on the side. Light conducting member 14 is provided to conduct the light from the illuminant 13 to the desired illuminating position on the knob 4.

Because rubber contact switch 10 of the embodiment having the above configuration is used as an opening and closing switch of the power window for the motor vehicle, the rubber contact switch 10 can switch on and off of either of the rubber contact portion 2A or 2B by one knob 4. The explanation is given hereinafter to define that the condition of pressing the press portion **43*a* is for opening the power window, and the condition of pulling up the pull up portion 43*b*** is for closing the power window.

When the press portion **43*a* on the knob 4 of the rubber contact switch 10 is pressed, the knob 4 rotates counterclockwise about the rotation shaft 45 as a center axis. Then, the rubber contact drive member 3A is moved down to the under side of FIG. 1 by the protrusion 44A, and the ring tops 26 on the rubber contact portion 2A and the hollow dome 24 are deformed to move the protrusion 24***a* downwardly. Accordingly, the movable contact points 27 come into contact with two fixed contact points 21*a* and 21*b* disposed on left side of the base plate 22 to electrically communicate with two fixed contact points 21*a*, 21*b*, and thus, a circuit in the rubber contact switch 10 is closed to open the power window.

On the other hand, when the pull up portion 43*b* of the knob 4 of the rubber contact switch 10 is pulled up, the knob 4 rotates clockwise about the rotation shaft 45. Then, the rubber contact drive member 3B is moved down in FIG. 1 by the protrusion 44B and the ring top 26 on the rubber contact portion 2B and the hollow dome 24 is deformed to move the protrusion 24*b* downwardly. Accordingly, the movable contact point 27 comes into contact with two fixed contact points 21*a*, 21*b* disposed on right side of the base plate 22 and thus, to electrically communicate with two fixed contact points 21*a* and 21*b* so that a circuit in the rubber contact switch 10 is closed to close the power window.

Figure 2:
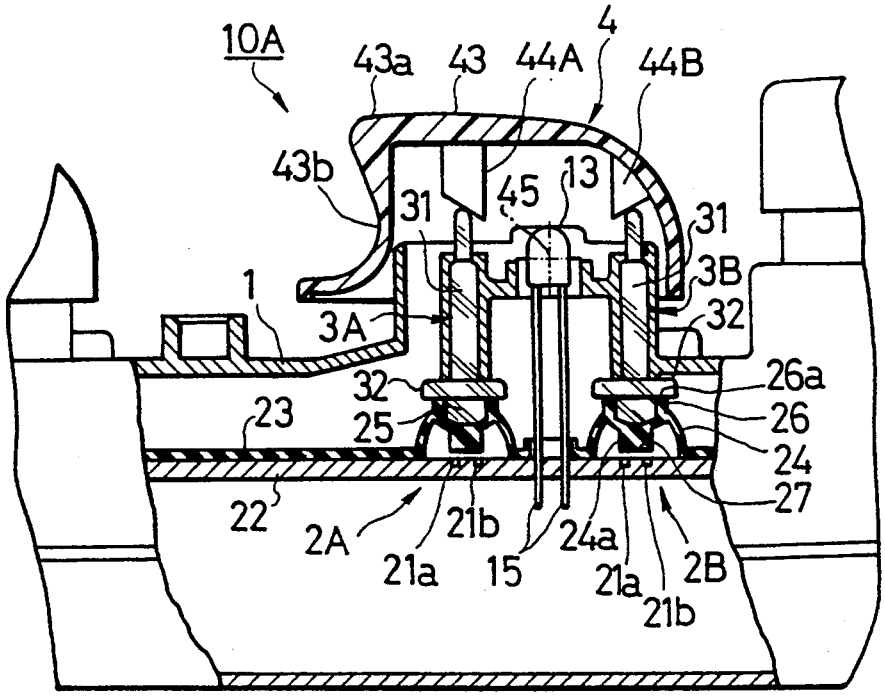
FIG. 2 is a sectional view showing a switch portion for rubber contact switch according to the second embodiment of this invention.

FIG. 2 is a sectional view of the rubber contact switch according to the second embodiment of this invention. In FIG. 2, the same reference numbers are used for the identical parts in FIG. 1 and the descriptions are omitted.

An illuminant 13 is mounted right under the knob 4. For example, a light emitting diode (LED) is used as the illuminant 13. A pair of lead wires 15 extend from the illuminant 13 through a base plate 22.

According to this embodiment, it is possible to improve the lighting efficiency because the illuminant 13 is mounted right under the knob 4. It is also possible to reduce the number of the parts and production costs because it is not necessary to mount a light conducting member 14.

Figure 3:
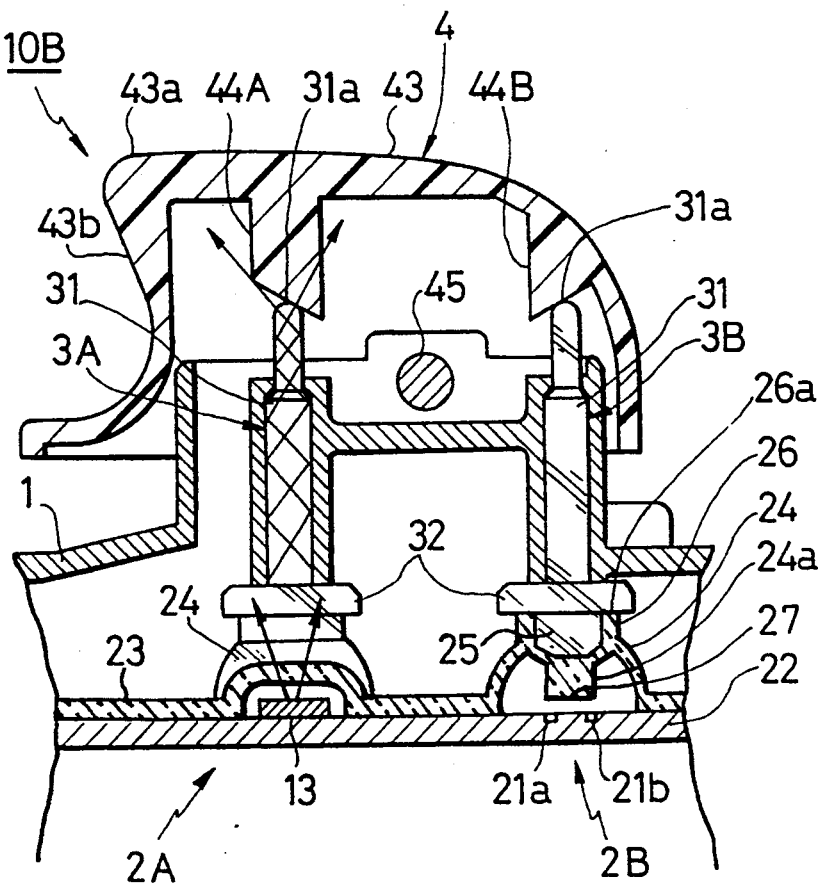
FIG. 3 is a sectional view showing a switch portion for rubber contact switch according to the third embodiment of the invention.

FIG. 3 is a sectional view according to the rubber contact switch regarding the third embodiment of the invention. In FIG. 3, the same reference numbers are used for the identical parts in FIG. 1 and the descriptions are omitted.

In this embodiment, a base plate 22 is made of polychlorinated biphenyl (PCB). Hollow domes 24, protrusions 24*a*, ring tops 26, etc. are made of transparent material such as silicon rubber or the like.

The illuminant 13 is mounted under flange portions 32 on the base plate 22 inside the hollow domes 24. That is, the illuminant 13 is mounted near a line which is extended from the axis of the rubber contact drive portion 3A, 3B. A light emitting diode (LED), for example, is used as an illuminant 13. Fixed contact points 21*a*, 21*b* and a movable connect point 27 are also provided on a rubber contact portion 2A, though these are not shown in FIG. 3.

The rubber contact drive members 3A, 3B are made of transparent material such as polycarbonate and acrylic and they also serve as light-conduct members. The rubber contact drive members 3A, 3B are mounted right under the protrusions 44A, 44B which are mounted right under the luminous points. Head portions 31*a* of the rubber contact drive members 3A, 3B are formed in a lens structure of a convex shape.

In this embodiment, the light (designated by arrows) which is radiated from the illuminant 13 penetrates through the hollow domes 24, etc., and further goes through the flange portions 32 into the shaft members 31. Then the light goes through inside the shaft members 31 and comes out from the head portions 31*a*. The light from the head portions 31*a* illuminates the illuminating points on the knob 4.

As described above, in this embodiment it is possible to illuminate the illuminating points of the knob 4 from right under the same because the rubber contact drive members 3A, 3B are made of a transparent material and the illuminant 13 is mounted under the flange portions 32 of the rubber contact drive members 3A, 3B. Thus, it is possible to improve flexibility of the illuminating points and to improve the illuminating efficiency.

It is also possible to reduce the production cost because it is not necessary to provide separate light conducting members so that the number of the parts decreases. This is because the rubber contact drive members 3A, 3B serve as light conducting members.

Furthermore, it is possible to scatter the light to prevent irregular illumination because the head portions 31*a* of the rubber contact drive members 3A, 3B each formed as a lens structure having a convex shape.

It is further possible to improve the water-proof and the dust-proof performance because the lead wires which penetrate the base plate 22 are not necessary.

What is claimed is:

1. A rubber contact switch comprising:

a housing;

a base plate;

a rubber contact portion disposed inside said housing, being mainly made of transparent material; a pair of fixed contact points disposed on said base plate and within said housing;

a movable contact point disposed on said rubber contact portion and within said housing, said movable contact point facing said fixed contact point and adapted for engagement contact with or separation from the fixed contact points;

a drive member of substantially transparent material capable of conducting light and having a shaft portion and a flange portion, said shaft portion being slidably supported by said housing in an axial direction thereof so that said flange portion is capable of reciprocating said rubber contact portion relative to said base plate to electrically connect or disconnect said movable contact point with said fixed contact point;

an illuminant being arranged so as to face said flange portion of said drive member and to radiate light to said flange portion; and a knob of substantially transparent material and being in contact with said drive member to reciprocate said drive member against said rubber contact portion;

wherein the shaft of said drive member has a head portion of convex shape which is in contact with said knob.

2. The rubber contact switch of claim 1, wherein said drive member reciprocates along a line and said illuminant is disposed near said line.

3. The rubber contact switch of claim 1, wherein said illuminant is a light emitting diode.

4. The rubber contact switch of claim 1, wherein said rubber contact portion further includes a recessed ring top facing away from said fixed contact point, said ring top has a given diameter, and said drive member flange portion has a diameter greater than said ring top diameter.

5. The rubber contact switch of claim 4, wherein said ring top and said flange form an inner space therebetween.

6. The rubber contact switch of claim 1, wherein said housing includes an outer sleeve portion and said shaft portion is at least partially enclosed within said sleeve portion.

7. A rubber contact switch comprising:

a housing;

a base plate;

a rubber contact portion disposed inside said housing, being mainly made of transparent material, said rubber contact portion including a hollow dome disposed on said base plate, said hollow dome further including:

a protrusion projecting from a top of said hollow dome toward said base plate, and a concave ring top disposed on the top of said hollow dome;

a pair of fixed contact points disposed on said base plate and within said housing;

a movable contact point disposed on said protrusion of said rubber contact portion and within said housing, said movable contact point facing said fixed contact point for engagement contact with or separation from said fixed contact points;

a drive member of substantially transparent material and having a shaft portion and a flange portion, said shaft portion being supported by said housing so that said flange portion is capable of reciprocating said rubber contact portion relative to said base plate to electrically connect or disconnect said movable contact point with said fixed contact points;

a knob of substantially transparent material and being in contact with an end portion of said drive member to reciprocate said flange portion of said drive member to said rubber contact portion; and an illuminant being disposed to face said flange portion of said drive member to radiate light to said flange portion;

wherein said drive member has a head portion of convex shape which is in contact with said knob.

8. The rubber contact switch of claim 7, wherein said drive member reciprocates along a line and said illuminant is disposed near said line.

9. The rubber contact switch of claim 7, wherein said illuminant is a light emitting diode.

10. The rubber contact switch of claim 7, Wherein said ring top has a given diameter, and said drive member flange portion has a diameter greater than said ring top diameter.

11. The rubber contact switch of claim 7, herein said ring top and said flange form an inner space therebetween.

12. A rubber contact switch, comprising:

a knob including at least one inner protrusion;

at least one contact drive member, each including a transparent shaft portion at a first end adjacent an inner protrusion and a flange portion at a second end thereof;

a base plate facing the inner protrusion and having at least one pair of upward-facing fixed electrical contact posts thereon;

a flexible base member integrally formed on the base plate, the base member including a plurality of upward-extending dome-shaped contact portions, each of which includes a movable electrical contact point therein confronting one of the pairs of electrical contact posts, the contact portions further including an integral and upward-facing concave ring top contacting the flange portion of a shaft member;

illuminant means for lighting said knob internally, disposed behind said knob; and means for communicating light from the illuminant means to the knob via the contact drive member, comprising a light conducting member extending between the illuminant means towards the knob.

13. The rubber contact switch of claim 12, further comprising a knob of substantially transparent material and being in contact with said drive member to reciprocate said drive member against said rubber contact portion.

14. The rubber contact switch of claim 13, wherein the shaft of said drive member has a head portion of convex shape which is in contact with said knob.

15. The rubber contact switch of claim 12, wherein said drive member reciprocates along a line and said illuminant is disposed near said line.

16. The rubber contact switch of claim 12, wherein said ring top has a given diameter, and said drive member flange portion has a diameter greater than said ring top diameter.

17. The rubber contact switch of claim 12, wherein said ring top and said flange form an inner space therebetween.

* * * * *